US011122880B1

(12) United States Patent
Blackner

(10) Patent No.: US 11,122,880 B1
(45) Date of Patent: Sep. 21, 2021

(54) PERSONAL HYGIENE ASSISTANCE DEVICE

(71) Applicant: Wade Blackner, Lithia, FL (US)

(72) Inventor: Wade Blackner, Lithia, FL (US)

( * ) Notice: Subject to any disclaimer, the term of this patent is extended or adjusted under 35 U.S.C. 154(b) by 0 days.

(21) Appl. No.: 16/793,086

(22) Filed: Feb. 18, 2020

(51) Int. Cl.

| | |
|---|---|
| ***A45D 34/04*** | (2006.01) |
| ***A45D 40/02*** | (2006.01) |
| ***A45D 34/00*** | (2006.01) |
| ***A45D 40/26*** | (2006.01) |

(52) U.S. Cl.
CPC ..... *A45D 34/04* (2013.01); *A45D 40/26* (2013.01); *A45D 2034/002* (2013.01); *A45D 2200/1081* (2013.01)

(58) Field of Classification Search
CPC .. A45D 34/04; A45D 40/26; A45D 2034/002; A45D 2200/1081; A45D 2234/005; A45D 2200/05; A45D 2200/10; A45D 2200/1036; A45D 2200/1045; B25J 1/00; B25J 1/04; B25J 1/06; B25J 1/12
USPC ..... 401/6–8, 48, 131, 88
See application file for complete search history.

(56) References Cited

U.S. PATENT DOCUMENTS

| | | | | |
|---|---|---|---|---|
| 4,961,661 | A * | 10/1990 | Sutton | A45D 34/04 401/140 |
| 5,605,572 | A * | 2/1997 | Berger | B43M 5/025 118/241 |
| 6,520,556 | B1 | 2/2003 | Hsu | |
| 7,004,520 | B2 | 2/2006 | Khubani et al. | |
| 7,037,016 | B1 * | 5/2006 | Nelson | A61H 7/003 401/196 |
| 8,715,252 | B2 * | 5/2014 | Connor | A61H 37/00 604/289 |
| 9,597,488 | B1 * | 3/2017 | Jones | B25G 1/06 |

* cited by examiner

*Primary Examiner* — David J Walczak
(74) *Attorney, Agent, or Firm* — Sanchelima & Associates PA; Christian Sanchelima; Jesus Sanchelima

(57) ABSTRACT

A personal hygiene assistance device including a handle assembly and a sleeve assembly. The handle assembly includes a handle which includes grip members at a distal end. The sleeve assembly includes a holding sleeve that is rotatably mounted in between the grip members of the handle. A product container is secured into the holding sleeve. The handle permits a user to reach hard to reach areas on the body of the user in order to apply medication or product from the product container unassisted. The holding sleeve and the product container are angled in a manner that facilitates the applying of the product to the user.

15 Claims, 4 Drawing Sheets

PERSONAL HYGIENE ASSISTANCE DEVICE

BACKGROUND OF THE INVENTION

1. Field of the Invention

The present invention relates to a personal hygiene assistance device and, more particularly, to a personal hygiene assistance device that allows a user to reach hard to reach areas on the user's body to facilitate the application of medications or other suitable products thereon.

2. Description of the Related Art

Several designs for personal hygiene assistance device have been designed in the past. None of them, however, include a personal hygiene assistance device comprising a pair of spring-loaded tongs having a cylindrical holding sleeve at the distal end for holding, grooming or medical application device. The device extends the reach of a user to facilitate the application of medication in hard to reach areas, such as the back of the user, without the assistance of another person.

Applicant believes that a related reference corresponds to U.S. Pat. No. 7,004,520 for a locking mechanism for elongated tools that are designed to engage objects from remote distances. Applicant believes that another related reference corresponds to U.S. Pat. No. 6,520,556 for a gripping device having a length adjusting mechanism. None of these references, however, teach of a rotatable cylindrical sleeve which can hold a product to be applied to a user's body on an area not so easily reached without assistance.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a reach device that allows a user to reach body parts that are otherwise difficult to reach such as the back of the user.

It is another object of this invention to provide a reach device that facilitates the application of products to the body of the user.

It is still another object of the present invention to provide a reach device that can be easily stored or transported.

It is also an object of the present invention to provide a reach device that can securely hold product containers of different dimensions.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
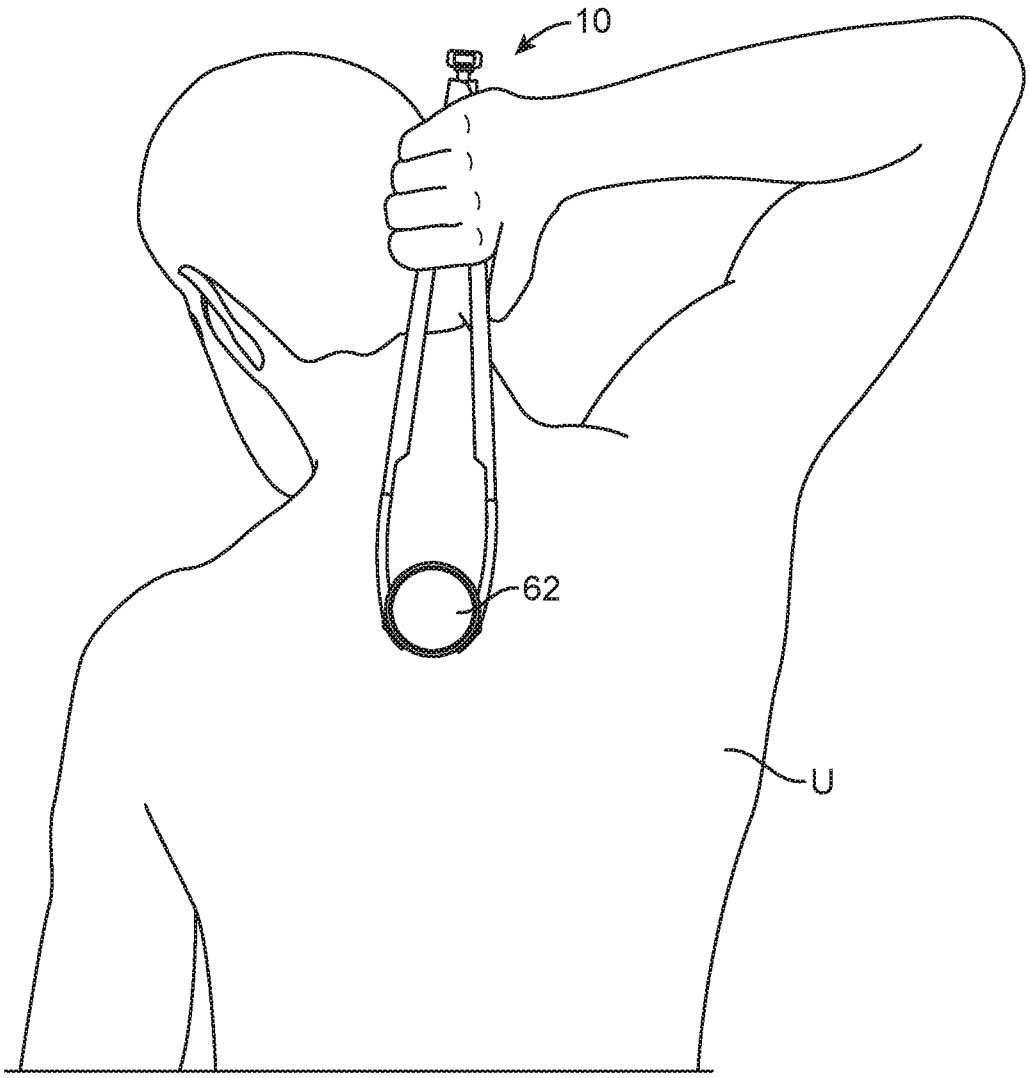
FIG. 1 represents the reach device 10 in an operational setting in which a user U is using the present invention to apply a medication from a product container 62 onto the back of the user U.
Figure 2:
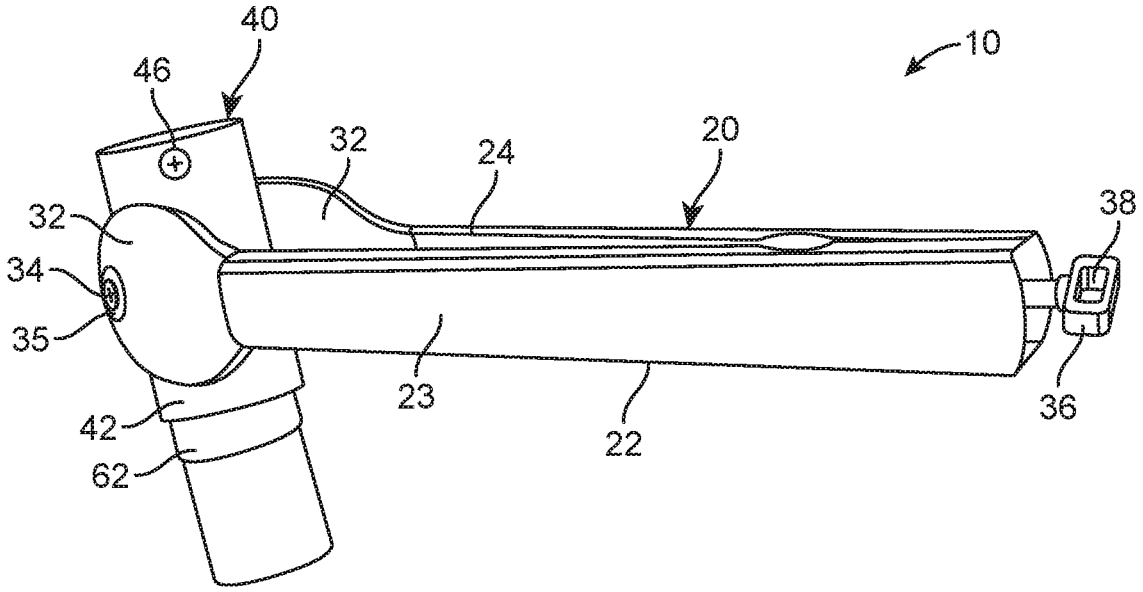
FIG. 2 shows an isometric view of the reach device 10.
Figure 3:
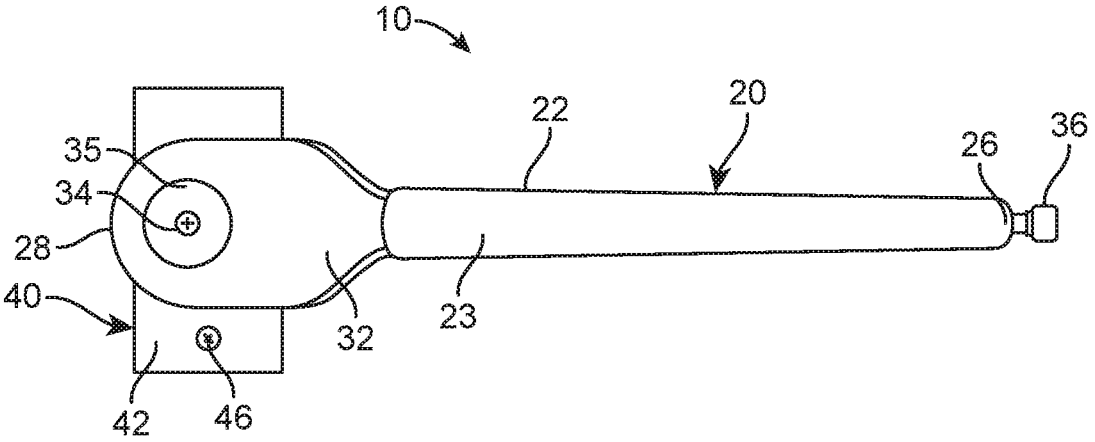
FIG. 3 illustrates a side view of the reach device 10 holding a product container 62.
Figure 4:
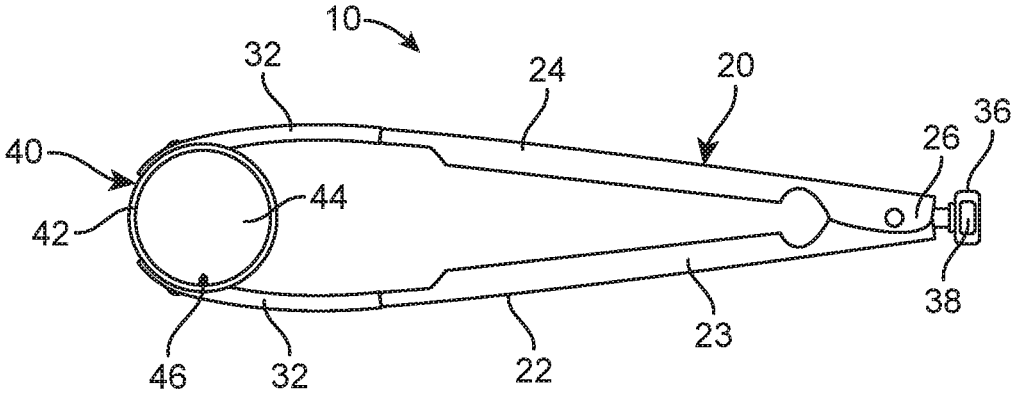
FIG. 4 is a representation of a top view of the reach device 10.
Figure 5:
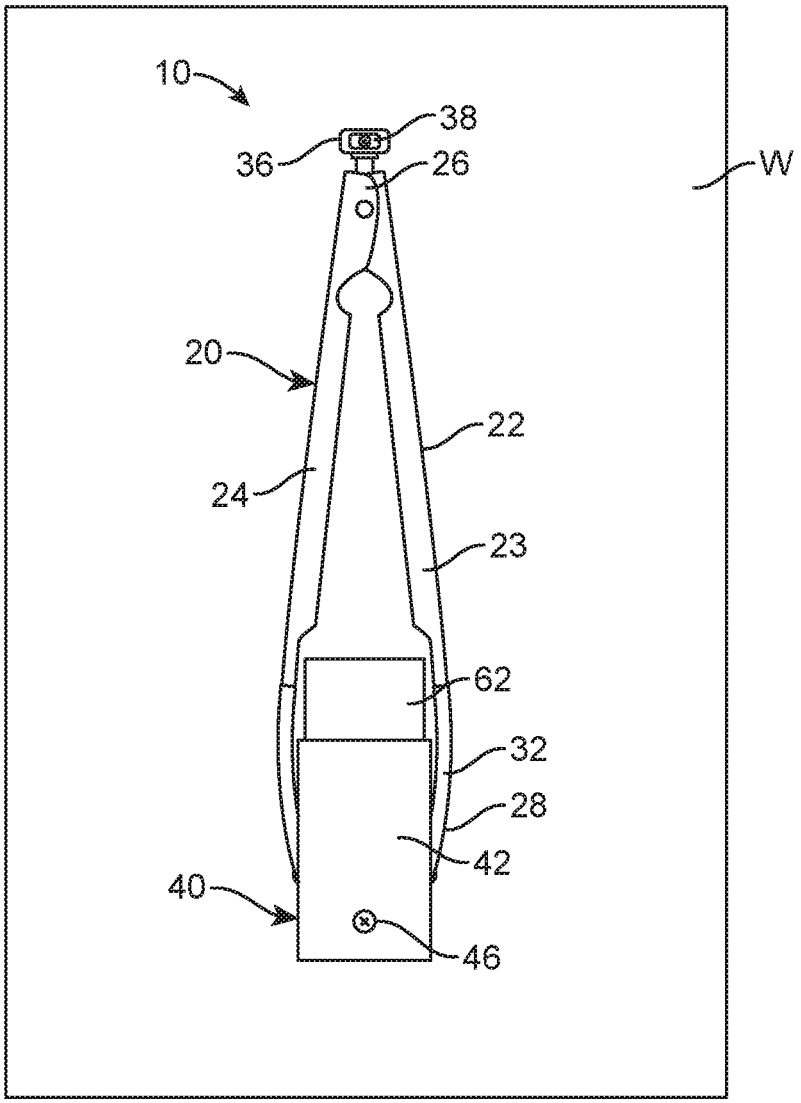
FIG. 5 shows the reach device 10 mounted to a wall W for storage.

Referring now to the drawings, where the present invention is generally referred to with numeral 10, it can be observed that it, reach device 10, basically includes a handle assembly 20 and a sleeve assembly 40.

Reach device 10 can facilitate the application of products from a product container 62 onto the body of a user U. Product container 62 may be an application device. Preferably, product container 62 may preferably be a roll-on application device. User U may apply products such as lotions, medication or other suitable products without the assistance of another person from product container 62. The products can easily be applied to hard to reach areas on the body of user U such as on the back of user U, for example. It should be understood that reach device 10 may be easily transported for usage anywhere.

Handle assembly 20 may include a handle 22. Handle 22 may allow user U to operate and maneuver the present invention. Handle 22 may be grasped by user U during usage of the present invention. It may be suitable to also refer to handle 22 as tongs. Handle 22 may suitable be a pair of spring-loaded tongs. Handle 22 may include a first arm 23 and a second arm 24. Handle 22 may further include a first end 26 and a second end 28. First arm 23 and second arm 24 may be mounted to each other at first end 26 with a fastening member, preferably. First arm 23 may be partially received within second arm 24 or vice versa, at first end 26. Handle 22 may be made of materials such as plastic, metal, aluminum, wood or other suitable materials. First arm 23 and second arm 24 may be elongated and rectangular in shape, in one embodiment. It may be suitable for first arm 23 and second arm 24 to taper outwardly from first end 26 to second end 28. Each of first arm 23 and second arm 24 may be U shaped. It is to be understood that the U shape of first arm 23 and second arm 24 may be facing each other. First arm 23 and second arm 24 may include a lip portion to have the U-shaped configuration. It should be understood that handle 22 may be of predetermined dimensions as per the needs of the user.

Handle 22 may further include grip members 32 at second end 28. Grip members 32 may be adapted to received and secure sleeve assembly 40 therebetween. Each of first arm 23 and second arm 24 may include one of grip members 32 at second end 28 of handle 22. Grip members 32 may have a width greater than the width of handle 22. It can be seen that grip members 32 may be rounded at distal ends thereof. Preferably, grip members 32 may be made of rubber, but other suitable materials may be used as well. Grip members 32 may provide safety to user U. Grip members 32 may be soft enough to avoid any accidental injury to the body of user U while the present invention is being operated to apply products from product container 62 onto user U. Any accidental scratching or cutting is avoided due to grip members 32. Even if grip members 32 make contact with user U no damage, injury or pain occurs to user U.

The present invention may further include pivots 34. At least one of pivots 34 may be mounted onto each of grip members 32. Pivots 34 may secure sleeve assembly 40 in between handle 22 or more specifically between grip members 32. It should be understood stood that pivots 34 may be able to freely rotate 360 degrees. Pivots 34 may be fasteners such as screws or other suitable fastening means or members. In one embodiment, underneath of each of pivots 34 may be a washer 35. Washer 35 may help facilitate the rotation of each of pivots 34 as sleeve assembly 40 is rotated about pivots 34.

Reach device 10 may be easily stored when not in use. Reach device 10 includes a hook 36 mounted to handle 22. More specifically, hook 36 may be mounted onto first end 26 of handle 22. Hook 36 may extend outwardly and away from handle 22. Wherein said hook 36 may be perpendicular to the handle. It may be suitable for hook 36 to be substantially rectangular or square shaped. In one embodiment, it may be suitable for hook 36 to include a cover. The cover may be made of rubber, preferably. Centrally located through hook 36 may be a hook opening 38. Preferably, hook opening 38 may be circular, however, any other predetermined shape may be suitable for hook opening 38. In one embodiment, hook 36 may have a width greater than handle 22. In an alternate embodiment, hook 36 may have a width less than handle 22. Hook 36 may be used to secure reach device 10 to an anchoring point such as a nail, screw or the like on a wall W. The anchoring point may be received through hook opening 38. Preferably, reach device 10 may be stored vertically. It may be suitable to store the present invention with product container 62 secured thereto. However, it may be preferable to store the present invention with product container 62 being vertical, which is possible due to pivots 34.

Reach device 10 includes sleeve assembly 40 which may be used to secure product container 62, with a product within, to handle 22. In one embodiment, product container 62 may include a cap. Sleeve assembly 40 may include a holding sleeve 42. Holding sleeve 42 may be hollow to secure or hold product container 62 therein. The holding sleeve 42 may be entirely open on a top face and a bottom face. Holding sleeve 42 may be secured between handle 22. More specifically, holding sleeve 42 may be secured between grip members 32 with pivots 34. The pivots 34 may be mounted perpendicularly to the grip members 32. It may be suitable for grip members 32 to be centrally mounted onto holding sleeve 42. Holding sleeve 42 may be able to freely rotate 360 degrees about pivots 34. Pivots 34 and holding sleeve 42 may rotate simultaneously. This allows user U to angle holding sleeve 42 at a necessary angle to apply the appropriate medication or product onto the body of user U easily. Holding sleeve 42 may preferably be cylindrical in shape. However, other predetermined shapes may be suitable for holding sleeve 42 as well. Holding sleeve 42 may include an open top face. It can be seen that holding sleeve 42 may include an opening 44 leading to an interior of holding sleeve 42. Opening 44 may be of a predetermined dimension to allow the fitting of different sized product container 62 within holding sleeve 42. In one embodiment, it may be suitable for holding sleeve 42 to also have an open bottom face or bottom end. In an alternate embodiment, the bottom face or bottom end of holding sleeve 42 may be closed.

There is a need to secure product container 62 within holding sleeve 42 especially during usage of the present invention. A fastener 46 may be mounted to the perimeter of holding sleeve 42. Preferably, fastener 46 may be on a lower portion of holding sleeve 42. The fastener 46 may be mounted perpendicularly to the holding sleeve 42. Fastener 46 may be a screw, a nail or other suitable means. Product container 62 may be inserted within holding sleeve 42. Subsequently, fastener 46 may be tightened or loosened to properly secure product container 62. With fastener 46 tightened product container 62 may remain immobile and secure within holding sleeve 42. User U may then use the present invention without worries about product container 62 coining loose or falling out from holding sleeve 42. User U may angle holding sleeve 42 as needed with pivots 34. Successively, user U may apply the needed product from product container 62 onto the body of user U without any assistance, even on hard to reach areas.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a personal hygiene assistance device, comprising:

a. a handle assembly including a handle with a first end and a second end, said handle including grip members at said second end, wherein the handle includes a first arm and a second arm, said first and second arm interconnected at said first end; and b. a sleeve assembly including a holding sleeve, said holding sleeve mounted in between said grip members, said holding sleeve being capable of rotating 360 degrees in between said grip members, said holding sleeve housing a product container, said handle adapted to allow a user to reach hard to reach areas on the body to apply product from the product container thereon.

2. The system of claim 1, wherein said handle is a pair of spring-loaded tongs.

3. The system of claim 1, wherein said holding sleeve is cylindrical shaped.

4. The system of claim 1, wherein said holding sleeve is secured in between said grip members with pivots, said pivots rotate 360 degrees, said pivots and said holding sleeve rotating simultaneously, said pivots positioning said holding sleeve and said product container at a predetermined angle simultaneously.

5. The system of claim 4, wherein a washer is underneath of said pivots, said washer being sandwiched between each one of said pivots and said grip members to facilitate rotation of said pivots, said pivots being substantially perpendicular to said grip members.

6. The system of claim 1, wherein mounted to said handle is a hook, said hook being mounted to said first end, said hook extending outwardly and away from said handle, said hook being perpendicular to said handle.

7. The system of claim 6, wherein said hook includes a hook opening, said hook opening adapted to receive an anchoring member therethrough, said hook opening adapted to hang said handle.

8. The system of claim 1, wherein said holding sleeve is substantially hollow.

9. The system of claim 1, wherein said holding sleeve includes an opening on a top face, said opening leading to an interior of said holding sleeve, said product container inserted into said holding sleeve through said opening.

10. The system of claim 1, wherein said holding sleeve is entirely open on a top face and bottom face.

11. The system of claim 1, wherein said sleeve assembly further includes a fastener mounted to said holding sleeve, said faster mounted perpendicularly to said holding sleeve, said fastener being on a lower portion of said holding sleeve, said fastener partially extending through said holding sleeve, said fastener may be tightened and loosened to secure or release, respectively, said product container from within said holding sleeve.

12. A system for a personal hygiene assistance device, comprising:

a. a handle assembly including a handle with a first end and a second end, said handle including a first arm and a second arm, said first arm and said second arm being interconnected at said first end, said handle including grip members at said second end, said grip members being on said first arm and said second arm, said handle assembly further including pivots, each one of said pivots mounted perpendicularly to said grip members, said handle assembly further including a washer underneath of each of said pivots, said washer sandwich between one of said pivots and one of said grip members, said pivots rotatable 360 degrees, said washer facilitating rotation of said pivots, said handle assembly further including a hook mounted to said first end, said hook extending outwardly and away from said handle, said hook being perpendicular to said handle, said hook further including a hook opening, said hook opening adapted to permit hanging of said handle, said handle being spring-loaded tongs; and b. a sleeve assembly including a holding sleeve, said holding sleeve being cylindrical shaped, said holding sleeve being hollow, said holding sleeve includes an opening on a top face, said opening leading to an interior of said holding sleeve, said holding sleeve mounted in between said grip members, said holding sleeve being capable of rotating 360 degrees in between said grip members, said pivots and said holding sleeve rotating simultaneously, said holding sleeve partially housing a product container, said product container inserted into said holding sleeve through said opening, said sleeve assembly further includes a fastener mounted to said holding sleeve, said faster mounted perpendicularly to said holding sleeve, said fastener being on a lower portion of said holding sleeve, said fastener partially extending through said holding sleeve, said fastener may be tightened and loosened to secure or release, respectively, said product container from within said holding sleeve, said handle adapted to allow a user to reach hard to reach areas on the body to apply product from the product container thereon, said product container positioned at a predetermined angle with said holding sleeve.

13. The system of claim 12, wherein a bottom face of said holding sleeve is entirely open.

14. The system of claim 12, wherein said product container is a medical application device.

15. The system of claim 12, wherein said product container is a roll-on application device.

* * * * *